US005603266A

United States Patent [19]

Nash

[11] Patent Number: 5,603,266

[45] Date of Patent: Feb. 18, 1997

[54] MODULAR PALLETS AND COMPONENTS THEREFOR

[75] Inventor: Abbey Nash, Toronto, Canada

[73] Assignee: Palletronix Corporation, Toronto, Canada

[21] Appl. No.: 562,561

[22] Filed: Nov. 24, 1995

[51] Int. Cl.[6] ..... B65D 19/12

[52] U.S. Cl. ..... 108/56.3; 108/51.3

[58] Field of Search ..... 108/56.1, 56.3, 108/51.1, 51.3, 901, 902

[56] References Cited

U.S. PATENT DOCUMENTS

| | | | |
|---|---|---|---|
| 3,438,164 | 4/1969 | Duepree | 108/902 X |
| 3,610,172 | 10/1971 | Wharton | 108/56.3 X |
| 3,804,032 | 4/1974 | Baucom | 108/56.3 |
| 3,915,099 | 10/1975 | Wies et al. | 108/56.3 |
| 4,604,014 | 8/1986 | Frano | 108/56.3 X |
| 4,738,204 | 4/1988 | Hammerberg | 108/56.3 X |
| 5,193,464 | 3/1993 | Morden | 108/56.3 |
| 5,195,440 | 3/1993 | Gottlieb | 108/51.3 |
| 5,351,629 | 10/1994 | Breezer et al. | 108/56.3 |
| 5,367,961 | 11/1994 | Arai et al. | 108/56.3 |
| 5,388,533 | 2/1995 | Pigott et al. | 108/56.3 |

FOREIGN PATENT DOCUMENTS

| | | | |
|---|---|---|---|
| 2203504 | 8/1972 | Germany | 108/56.3 |
| 1362075 | 7/1974 | United Kingdom | 108/56.3 |

*Primary Examiner*—Jose V. Chen
*Attorney, Agent, or Firm*—Mirek A. Waraksa

[57] ABSTRACT

A post in a modular pallet includes a male part and a female part shaped to receive the male part along a predetermined axis. Complementary locking structure, such as mating screw thread segments or mating ratchet teeth, are formed with the male and female parts and interlock progressively to resist relative axial separation of the parts when the pans are placed in a predetermined locked orientation. Complementary detent structures resist displacement of the parts from their locked orientation toward an unlocked orientation in which the parts separate axially.

23 Claims, 10 Drawing Sheets

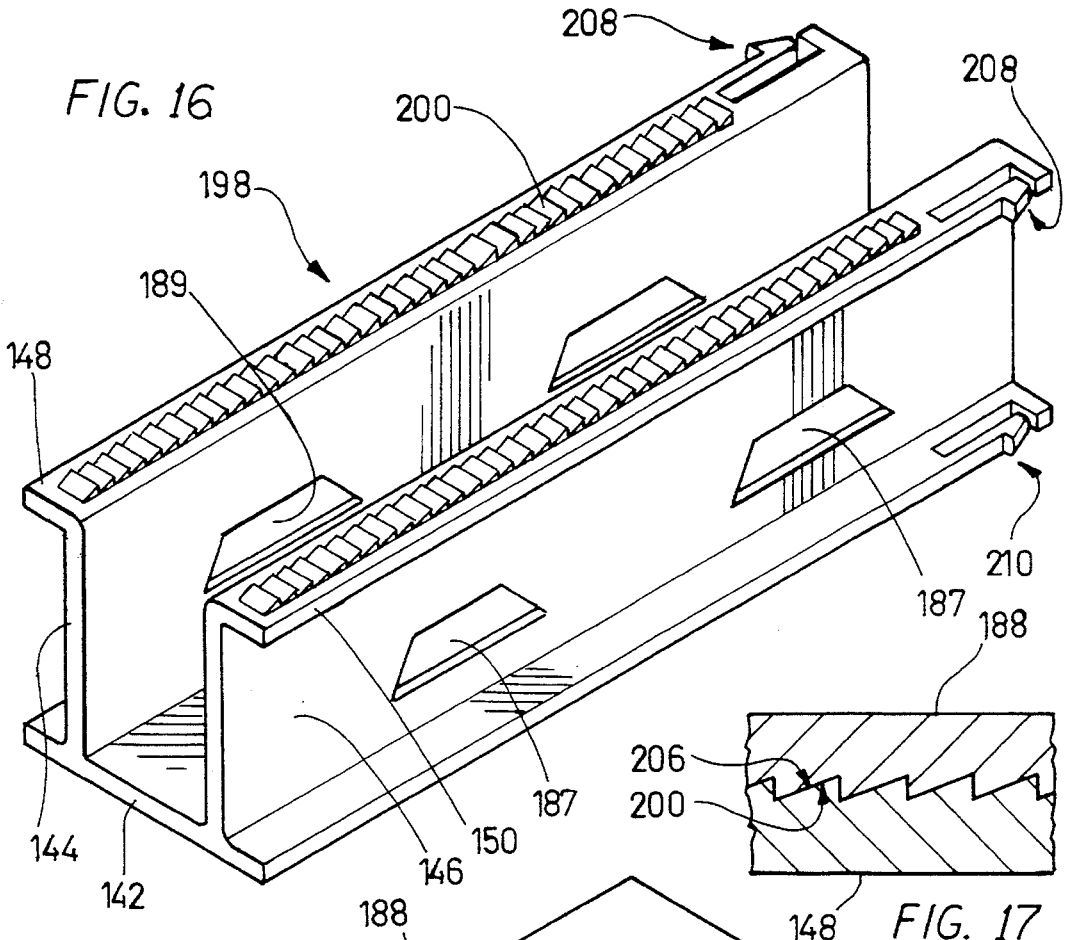
FIG. 16
FIG. 17
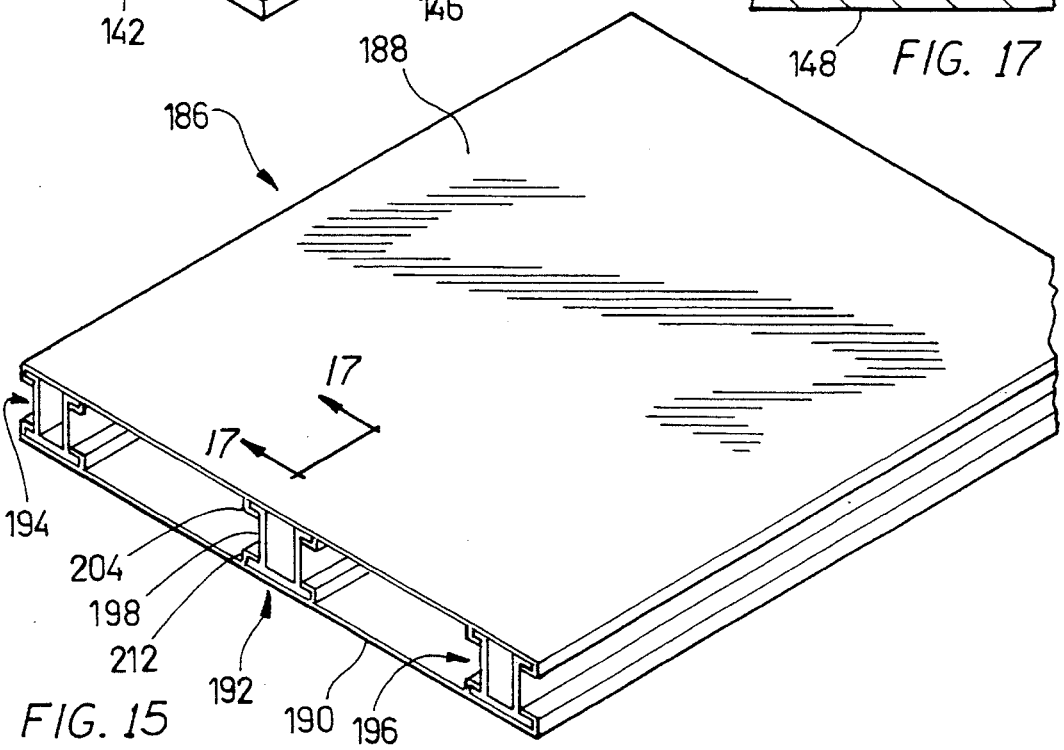
FIG. 15

MODULAR PALLETS AND COMPONENTS THEREFOR

FIELD OF THE INVENTION

The invention relates generally to pallets for supporting articles during shipping or storage, and more particularly to modular pallets and components for assembly of such pallets.

DESCRIPTION OF THE PRIOR ART

Pallets have consisted of an upper wood deck nailed to several horizontal wood posts. A lower deck has often been nailed to the posts to increase the rigidity of the pallet. Although the performance of such pallets has been satisfactory, shipping from a manufacturing plant to end users has been costly since the pallets occupy significant space. For reasons of conservation, it would also be desirable to construct pallets of alternative materials so that components can be recycled or re-used more economically and effectively. Corrugated paper materials have been substituted for both decks and posts, but such pallets have also not been entirely satisfactory. If such a pallet rests on a floor covered with water, its corrugated posts tend to wick water and weaken, and the loads supported by the pallet, particularly overlying pallets stacked with articles can cause the pallet to collapse.

Modular pallets have been proposed in which an upper deck is formed with clearance holes and generally circular plastic posts are mounted in the holes. The posts might typically comprise an upper male part that extends through a clearance hole and screw fits into a female part that supports the deck from below. To enhance rigidity, a lower deck may be provided, which has additional clearance holes aligned with the holes provided in the upper deck, and the posts may be formed with lower male parts that screw fit into the female parts from below, securing the lower deck therebetween.

Such modular pallets can be shipped disassembled, reducing space requirements and shipping costs. Use of screw threads accommodates different deck thickness, and allows disassembly of components for re-use if a deck is damaged. However, such prior art pallets have a significant shortcoming. The components of the posts tend to loosen in response to shocks and vibrations that occur during pallet handling.

SUMMARY OF THE INVENTION

In one aspect, the invention provides a post for use with a pallet deck, which comprises a pair of interlocking parts, one part which mounts to the pallet and receives the other part in a predetermined direction along a predetermined axis. Locking means are provided which comprise complementary locking structures mounted on the two parts and shaped to interlock to achieve a predetermined locked orientation in which axial separation of the parts is resisted. Detent means are provided to resist displacement of the parts from their locked orientation toward an unlocked orientation. The detent means comprise complementary detent structures which are positioned on the parts to engage when the parts are displaced relative to one another toward their locked orientation. In one embodiment, the post is adapted to mount in a clearance hole formed in the deck, one pan being essentially a male part shaped to abut one face of the deck and extend through the clearance hole, and the other part being a female part shaped to abut the other face of the deck and to allow relative rotation of the received male pan about the axis from the unlock to the locked orientation. In another embodiment, one part is integrally molded with the deck and defines an elongate track, and the other part is an elongate insert that interlocks progressively with the track until a predetermined position relative to the deck is reached and detent structures engage.

In another aspect, the invention provides a post adapted for attachment to a pallet deck which has a clearance hole extending between its opposing faces. The post comprises a male part that abuts one face of the deck and extends through the clearance hole, and a female part that abuts the other face of the deck, receives the male part along a predetermined axis, and allows relative rotation of the received male part about the axis. Locking means are provided to lock the male part to the female pan to resist relative axial separation in various relative axial positions thereby accommodating the thickness of the deck. The locking means comprise locking structures circumferentially spaced about the exterior of the male pan and interior of the female pan, effectively arranged in complementary pairs shaped for relative rotation about the predetermined axis between an unlocked orientation allowing axial separation of the pans and a locked orientation resisting such separation. Detent means, comprising complementary detent structures formed externally on the male part and internally on the female part, engage to resist relative rotation from the locked orientation toward the unlocked orientation. In a preferred implementation, the male part must be rotated relative to the female part through a predetermined angle from the locked orientation to the unlocked orientation, and the detent structures are positioned to engage and resist such rotation through part of the predetermined angle and then to disengage. This arrangement resists releasing of the parts during general handling of the pallet, but allows separation of the pans for disassembly of the pallet. To secure upper and lower decks, the post may comprise another male part which fastens in a The pallet post described above can be used to assemble a modular pallet which is yet another aspect of the invention. In that aspect, the invention provides a unitary foldable blank which has a central rectangular portion and a lateral flap extending from each side of the central portion along a hinge line. Each lateral flap has several panels joined by hinge lines so that the flap folds into a tubular structure in which an upper panel abuts one face of the central portion and a lower panel is spaced from the one face. A clearance hole in the upper panel overlays a clearance hole in the central portion of the blank, and another clearance hole is formed in the lower panel spaced from the central portion of the blank. A post is mounted to the tubular structure, the post comprising a part located within the tubular structure with opposing ends at the clearance holes, and a pair of parts that fasten to the opposing ends of the part within the tubular structure thereby to secure the central portion and upper panel and the lower panel to the post. When assembled, the blank defines a deck with tubular structures along all sides that enhance the structural rigidity of the pallet. The tubular structures are themselves reinforced with one or more posts, which are preferably plastic. If the tubular structures wick water from a floor during storage of articles, the posts still provide support against collapse. Clearance holes can be formed in panels of the flaps that orient perpendicular to the central portion of the blank when the tubular structures are formed, to receive the tines of a conventional forklift.

In another aspect, the invention provides a modular pallet construction which lends itself to manufacture from plastic. The pallet comprises a deck formed with elongate tracks in parallel spaced-apart relationship along one face. Each track is associated with an elongate insert shaped to interlock with the track and displace in interlocked relationship in a predetermined direction along the track between an unlocked orientation separate from the track and a predetermined locked orientation in which the insert is positioned as required against the deck face. The track and insert comprise complementary locking structures along their lengths shaped to interlock progressively as the insert is displaced along the track to the predetermined locked orientation and to resist displacement of the insert in an opposite direction. The track and insert comprise complementary detent structures that engage as the insert reaches its predetermined locked orientation and then resist displacement of the insert in the predetermined direction. In one embodiment, the locking structures are sets of ratchet teeth, and, in another embodiment, the locking structures comprises spring-biased projections, preferably integrally formed with the insert, which are received in complementary recesses, preferably formed in the deck along their various tracks. The pallet may comprise upper and lower deck, both formed with tracks as described above, and the inserts may be configured to simultaneously join the two decks. The overall configuration involving upper and lower decks spaced by inserts imparts significant structural rigidity. Consequently, when fabricated of plastic, the decks may be considerably lighter than prior art plastic decks.

Several aspects of the invention have been summarized in particular contexts and applications. Various aspects of the invention will be more apparent from a description below of preferred embodiments and will be more specifically defined in the appended claims.

DESCRIPTION OF THE DRAWINGS

The invention will be better understood with reference to drawings in which:

FIG. 15 is a fragmented perspective view showing an alternative pallet of entirely plastic construction;

FIG. 16 is a perspective view of an alternative insert used to define a post associated with the alternative pallet;

FIG. 17 is a view along lines 17—17 of FIG. 16 showing matching ratchet teeth that constitute locking structures securing the alternative insert to the alternative pallet.

DESCRIPTION OF PREFERRED EMBODIMENTS

Figure 1:
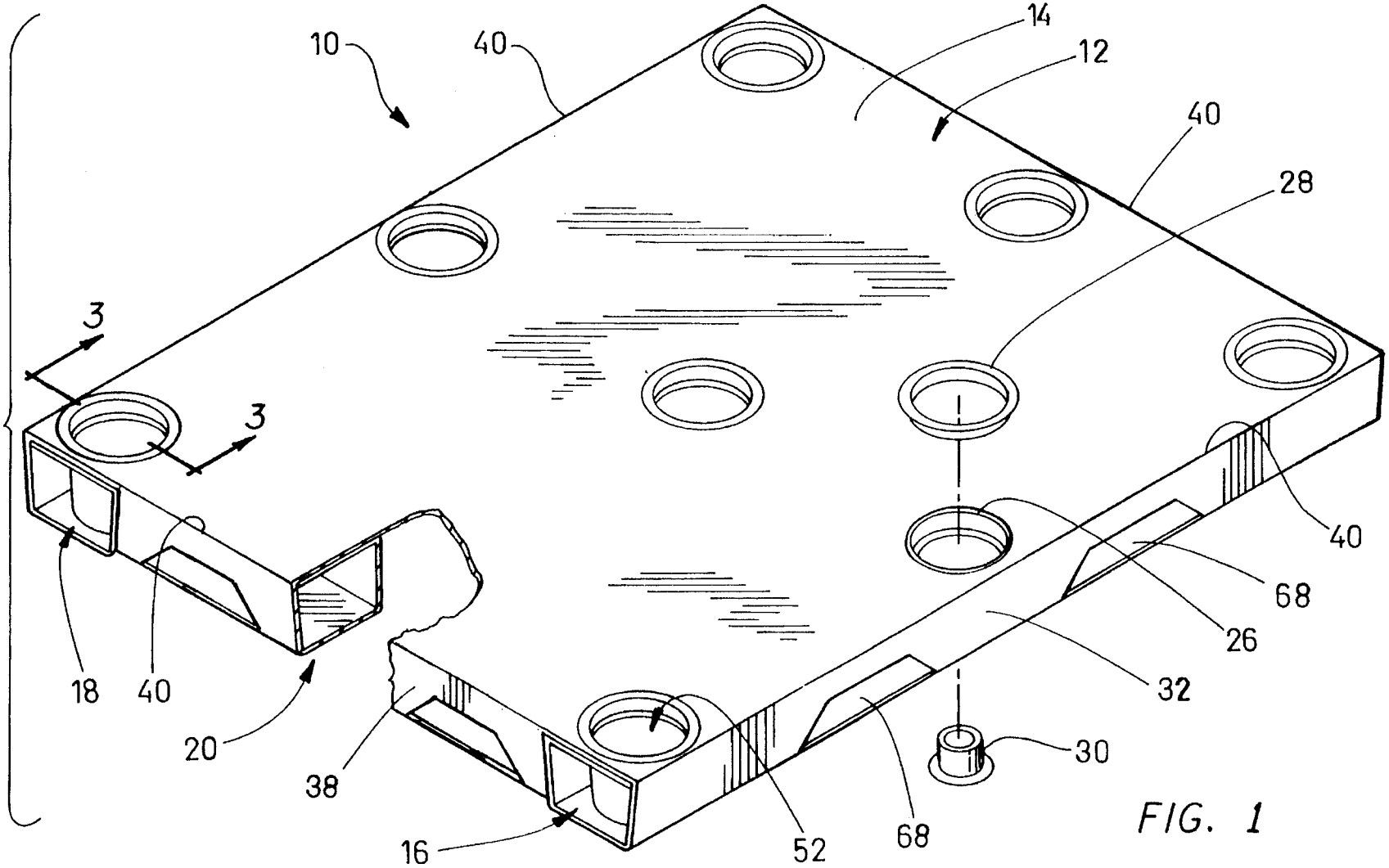
FIG. 1 is a fragmented perspective view of a modular pallet formed from a corrugated blank and multiple posts.
Figure 2:
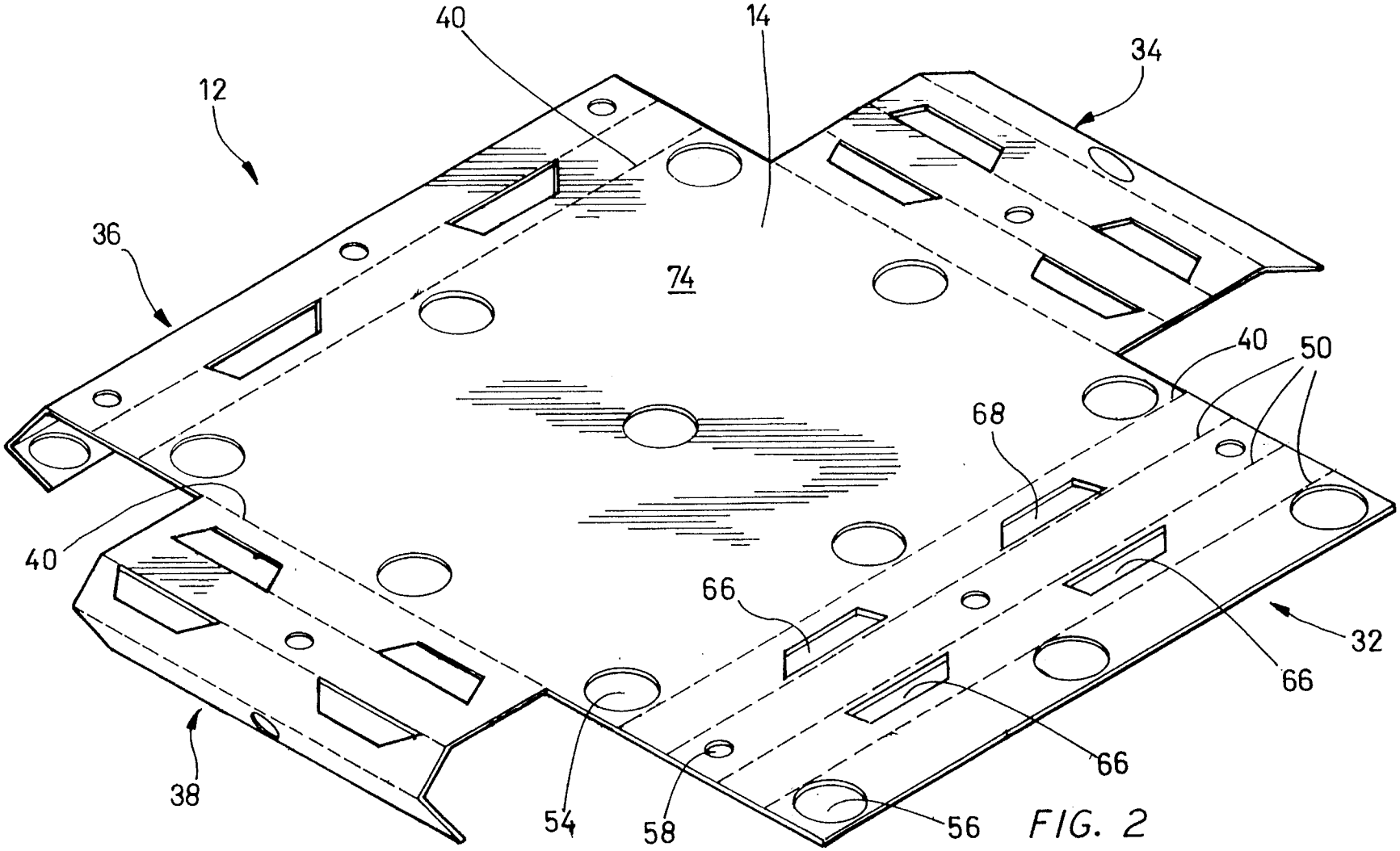
FIG. 2 is a fragmented perspective view of the corrugated blank partially unfolded.

Reference is made to FIG. 1 which illustrates a modular pallet 10. The pallet 10 comprises a corrugated blank 12 which is initially planar but folds into an upper deck 14 and four tubular structures 16, 18, 20, 22 of generally rectangular cross-section that impart rigidity to the deck 14. The tubular structures 16, 18, 20, 22 are retained in their tubular orientation and reinforced with plastic posts, such as the post shown exploded in FIG. 1 and stripped is detail. The post has a female part 26 which locates within the tubular structure 16 and serves as a rigid spacer, and upper and lower male parts 28, 30 which serve essentially as caps that fasten to the female pan 26 to secure the tubular structure 16 and deck 14. Various components of the blank 12 will be described in greater detail below.

The blank 12 has a central rectangular portion which serves as the deck 14. The blank 12 has lateral flaps 32, 34, 36, 38 which extend from each side of the deck 14 along hinge lines 40 pressed into the blank 12 during die-cutting. The flap 32 whose construction is typical comprises four rectangular panels 42, 44, 46, 48 joined by parallel hinge lines 50 that permit the flap 32 to be folded conveniently into the tubular structure 16. During such folding, one panel 42 locates uppermost and against a lower face 49 of the deck 14 and another panel 46 locates lowermost and parallel to the lower face 49. Three posts are used to secure the tubular structure 16. The post 52 which is typical is mounted to the tubular structure 16 with a set of clearance holes: a large clearance hole 54 formed in the deck 14 adjacent to one hinge line; a slightly larger clearance hole 56 formed in the upper panel 42 and positioned to overlay the clearance hole 54 in the deck 14 when the tubular structure 16 is assembled; and a smaller clearance hole 58 formed in the lower panel 46 which registers vertically with the two other clearance holes 54, 56 in the assembled tubular structure 16. As apparent in FIG. 3, a female part 60 of the post 52 locates within the tubular structure 16 between the upper and lower panels 42, 46 with its upper and lower ends overlaying the clearance holes. An upper male part 62 fastens to the upper end portion of the female part 60 to secure the deck 14 and the upper panel 42 therebetween, and a lower male part 64 fastens to the lower end portion of the female part 60 to secure the lower panel 46 therebetween.

The pallet 10 is adapted to be lifted with a conventional forklift. In the tubular structure 16, two panels 44, 48 which are oriented perpendicular to the lower face 49 of the deck 14 when the tubular structure 16 is assembled have clearance holes dimensioned to receive the tines of a forklift. Two such clearance holes 66 register horizontally when the tubular structure 16 is formed to define a continuous horizontal passage through the tubular structure 16. Two other clearance holes 68 register during assembly of the tubular structure 16 to define another continuous horizontal passage spaced from the other passage according to the standard spacing associated with forklift tines. Similar clearance holes (not numbered) are formed in the opposing tubular structure 20 and define another pair of continuous horizontal passages that register horizontally with the passages of the tubular structure 16, allowing the forklift tines to extend fully through the two opposing tubular structures 16, 20. The other pair of opposing tubular structures 18, 22 are formed with similar clearance holes (not specifically indicated), thereby permitting a forklift to approach the pallet 10 from all four sides.

The post 52 is further detailed in FIGS. 3–6. The female part 60 is shaped to receive the upper male part 62 along a central axis 70 of the female part 60 and to allow relative rotation of the upper male part 62 about the axis 70. The male part 62 is integrally formed with a circumferential flange 72 that butts against the upper face 74 of the deck 14 and a cylindrical sidewall 76 that extends through the clearance holes 54, 56. The exterior of the cylindrical sidewall 76 is formed with four identical locking structures (such as the structure locking structure 78 apparent in FIGS. 3 and 4, structure 80 apparent in FIG. 4, and structure 82 apparent in FIG. 6) equally spaced circumferentially and each spanning a sector of about 20 degrees. The locking structure 82, which is typical, comprises three screw thread segments 84 that are parallel, vertically registered, and inclined at a common angle. The female part 60 comprises an upper annular shoulder 86 that locates within the clearance hole 56 in the upper panel 42, a circumferential flange 88 that butts against the upper panel 42, and an upper cylindrical sidewall 90. The upper sidewall 90 of the female part 60 is formed internally with four complementary locking structures (such as structures 92, 94, 96 apparent in FIGS. 3–6) equally spaced circumferentially and each spanning sectors of about 20 degrees. The locking structure of the female part 60, which is typical, comprises three screw thread segments 98 which are parallel, vertically registered, and inclined at the same common angle. The locking structures of the two parts 60, 62 form complementary pairs which interlock simultaneously, such as the pair of locking structures 82, 96 shown interlocked in FIG. 6.

Figure 3:
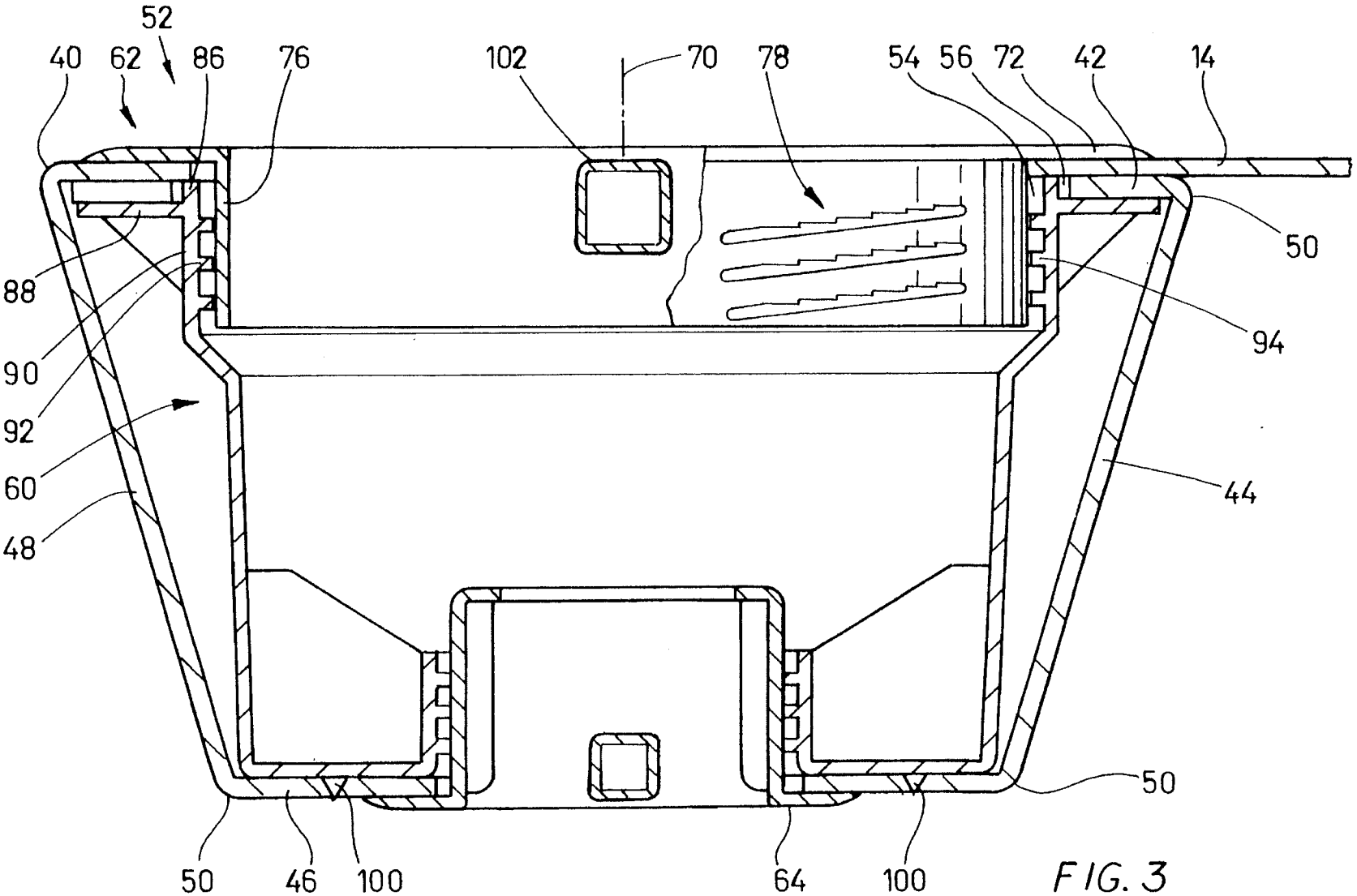
FIG. 3 is a view along lines 3—3 showing the cross section of one of the posts.
Figure 4:
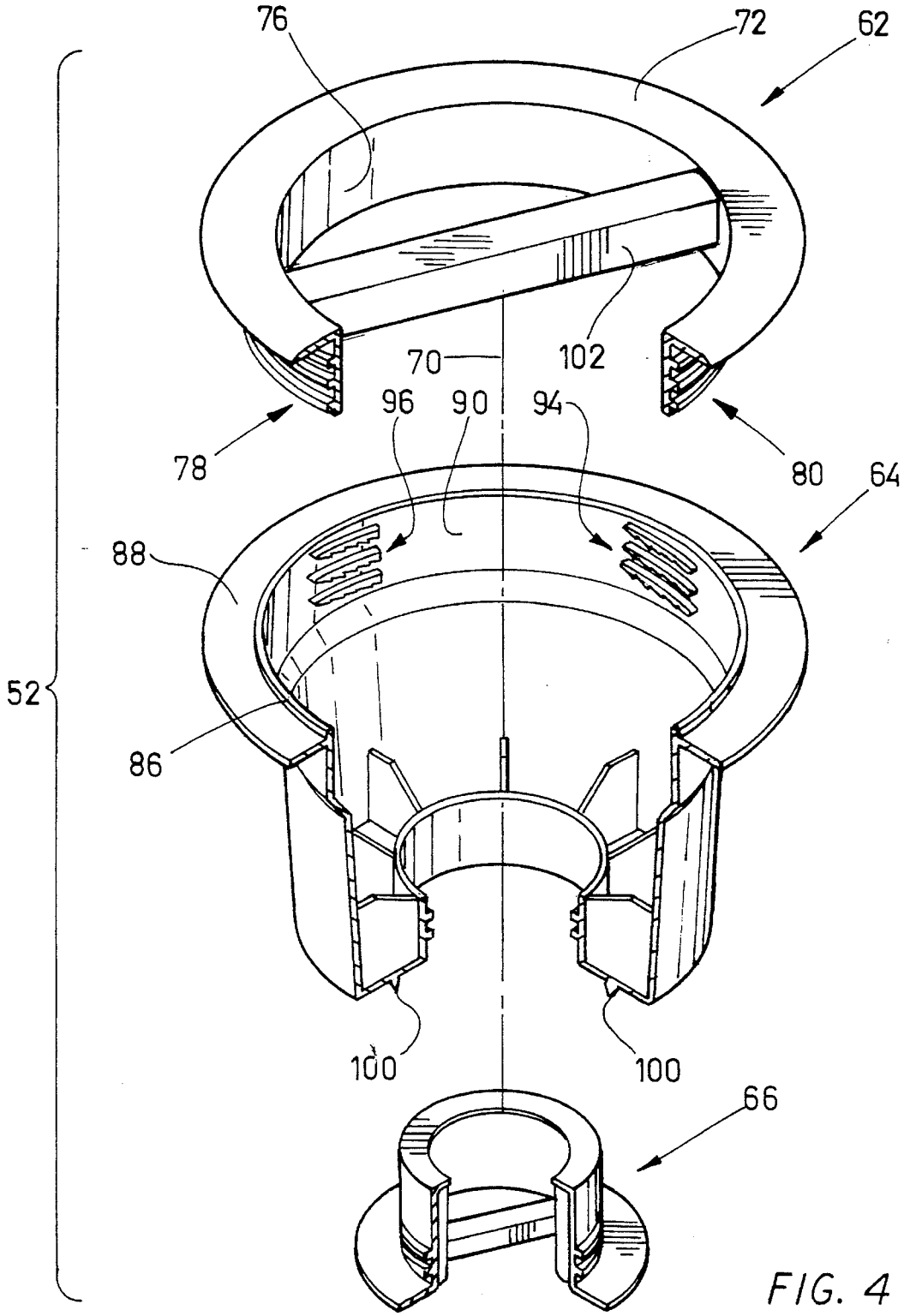
FIG. 4 is an exploded perspective view, partially fragmented, of the three principal parts of the post.
Figure 5:
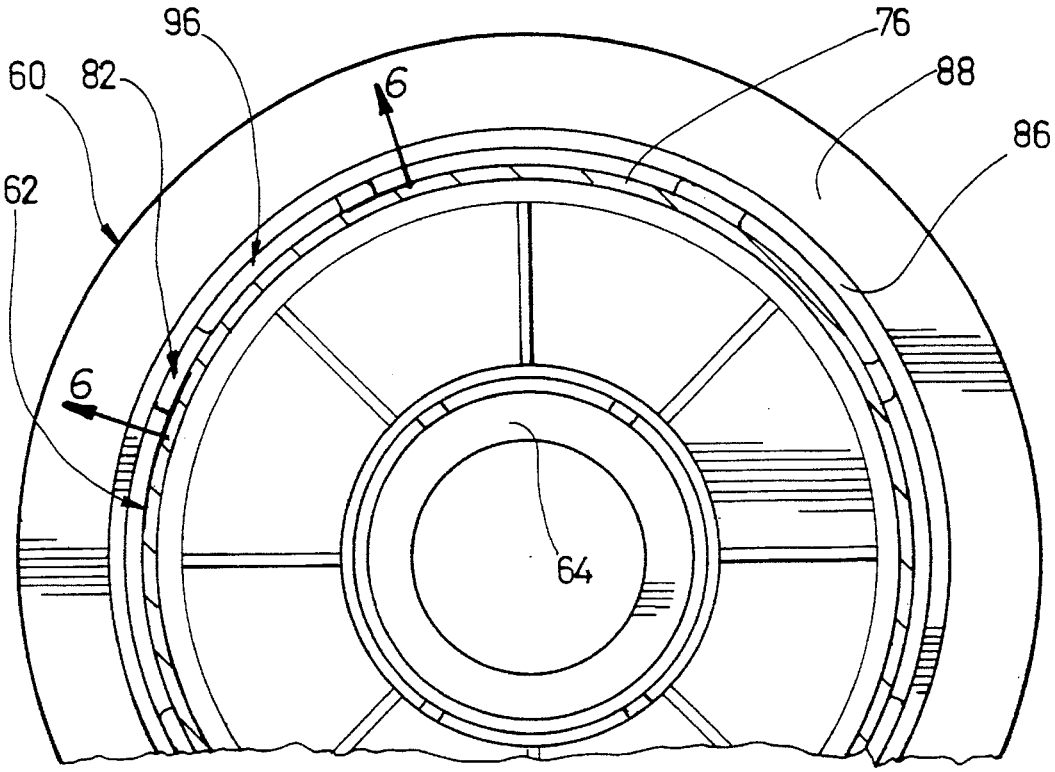
FIG. 5 is a view is a plan view showing an upper male inserted into a female part with the upper male pan in cross-sectioned in a horizontal plane.
Figure 6:
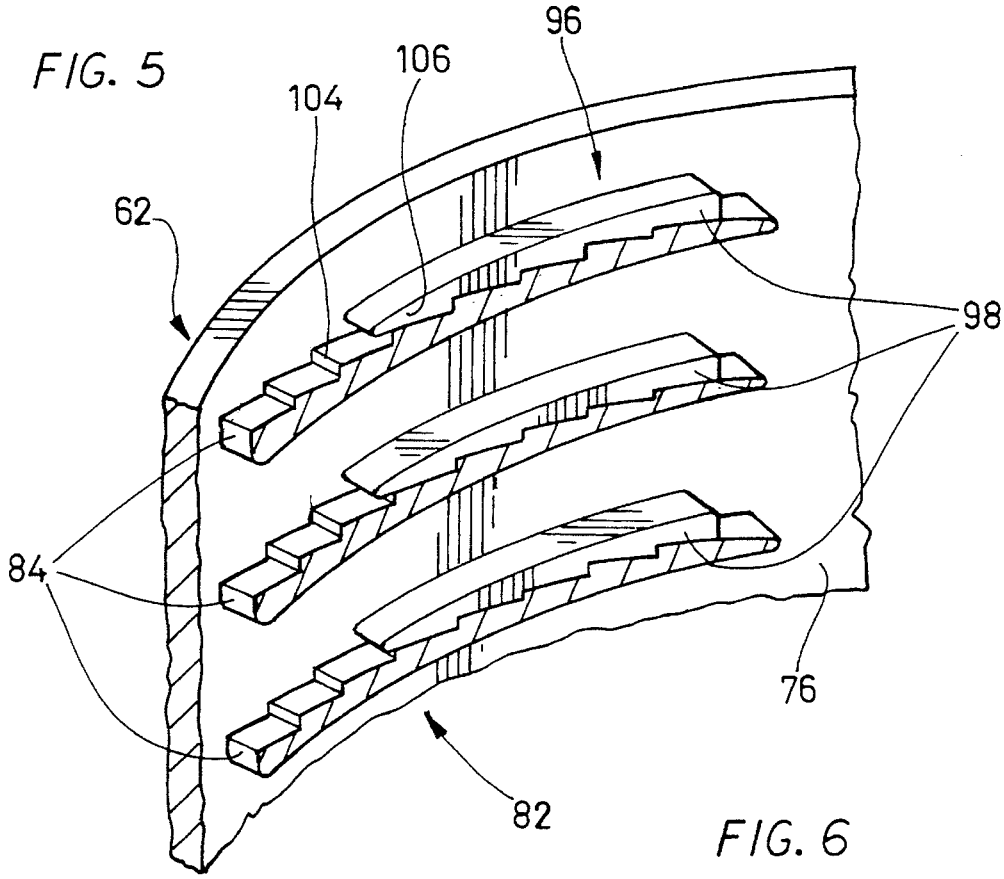
FIG. 6 is a perspective view along lines 6—6 of FIG. 5 showing cooperating sets of screw thread segments that lock the parts against axial separation and complementary ratchet teeth formed on the segments and constituting detent mechanisms for resisting relative angular rotation of the parts.

In an unlocked orientation (as for example in FIG. 4), the upper male part 62 can be displaced axially relative to the female part 60 through various relative axial positions until, for example, the relative axial orientation of FIG. 3 is achieved. In the relative axial orientation of FIG. 3, the deck 14 and the upper panel 42 are sandwiched between the flanges of the male and female parts 60, 62, but the two parts 60, 62 are not yet locked against relative axial separation. To achieve a locked orientation in which axial separation is resisted, the upper male part 62 must still be rotated counter-clockwise (as viewed from above) about the central axis 70. To facilitate such manual rotation, the lower surface of the female part 60 is formed with spikes 100 that penetrate the lower panel 46 to hold the female part 60 stationary, and the upper male part 62 is formed with a central cross-bar 102. During such rotation, the upper male part 62 may be pressed further into the female part 60 in order to engage the locking structures. As the complementary screw threads segments 98 progressively interlock in response to rotation, the upper male part 62 is drawn axially into the female part 60 thereby to better gripping the upper panel 42 and the deck 14. An interlocked relationship between the complementary locking structures 82, 96 is shown in FIG. 6. In FIG. 6, all three screw thread segments 84, 98 associated with each of the locking structures 82, 96 are engaged in the locking. However, a locked orientation can be achieved with different subsets of the screw thread segments 84, 98, allowing blanks of different thickness to be accommodated. In preferred from, the locking structures of both pans 60, 62 are both formed with multiple screw thread segments, but technically the locking structures of one part may each consist of a single screw thread segment.

The female part 60 and the upper male part 62 are formed with complementary detent structures that resist relative rotation of the pans 60, 62 from the locked orientation (as shown in FIG. 6) back to an unlocked orientation (as shown in FIG. 3). In this embodiment, the detent structures are formed on the screw thread segments of the locking structures themselves. The complementary pair of locking structures 82, 96 shown in FIG. 6 are typical. Upper surfaces of the screw thread segments 84 associated with the upper male part 62 are formed with sets of ratchet teeth (such as the exemplary set indicated generally with reference numeral 104) and lower surfaces of the screw thread segments 98 associated with the female part 60 are formed with complementary sets of ratchet teeth (such as the exemplary set indicated generally with reference numeral 106). The sets of ratchet teeth 104, 106 are shaped to progressively interlock as the upper male part 62 is rotated in the counter-clockwise direction and to resist rotation in the clockwise direction. In this embodiment, the detent structures cannot be released and the parts 60, 62 separated unless the corrugated blank 12 is destroyed.

The lower male part 64 is identical to the upper male part 62, except for scale, and fastens to a lower end of the female pan 60 in a similar manner. The lower male part 64 is once again received within the female part 60 along the central axis 70 and can be located in various relative axial positions selected to accommodate the thickness of the lower panel 46 sandwiched between the two parts 60, 64. The female part 60 is formed internally with locking and detent structures that cooperate with corresponding components on the exterior of the lower male part 64.

An alternative post 108 appropriate for the pallet 10 of FIG. 1 is illustrated in FIGS. 7–11. The construction of the post 108 permits convenient disassembly and removal of the post 108. The post 108 comprises a female part 110 together with upper and lower male pans 112, 114, which have been indicated with unique reference numerals. Features of those parts which are similar to those of the post 52 of FIGS. 3–6 have been indicated with common reference numerals, and the description below will highlight differences in construction or function.

Figure 7:
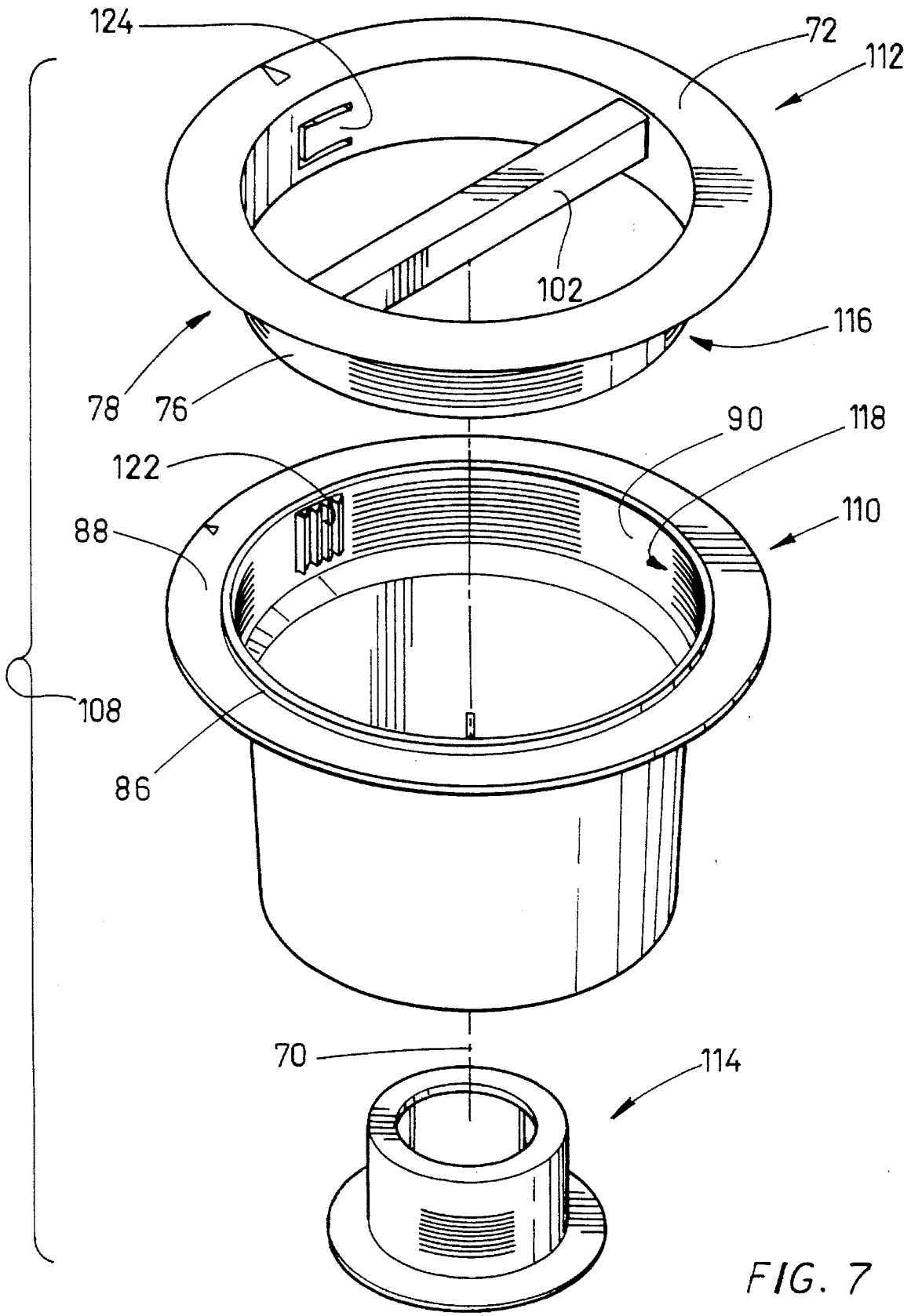
FIG. 7 is an exploded perspective view of an alternative post.
Figure 11:
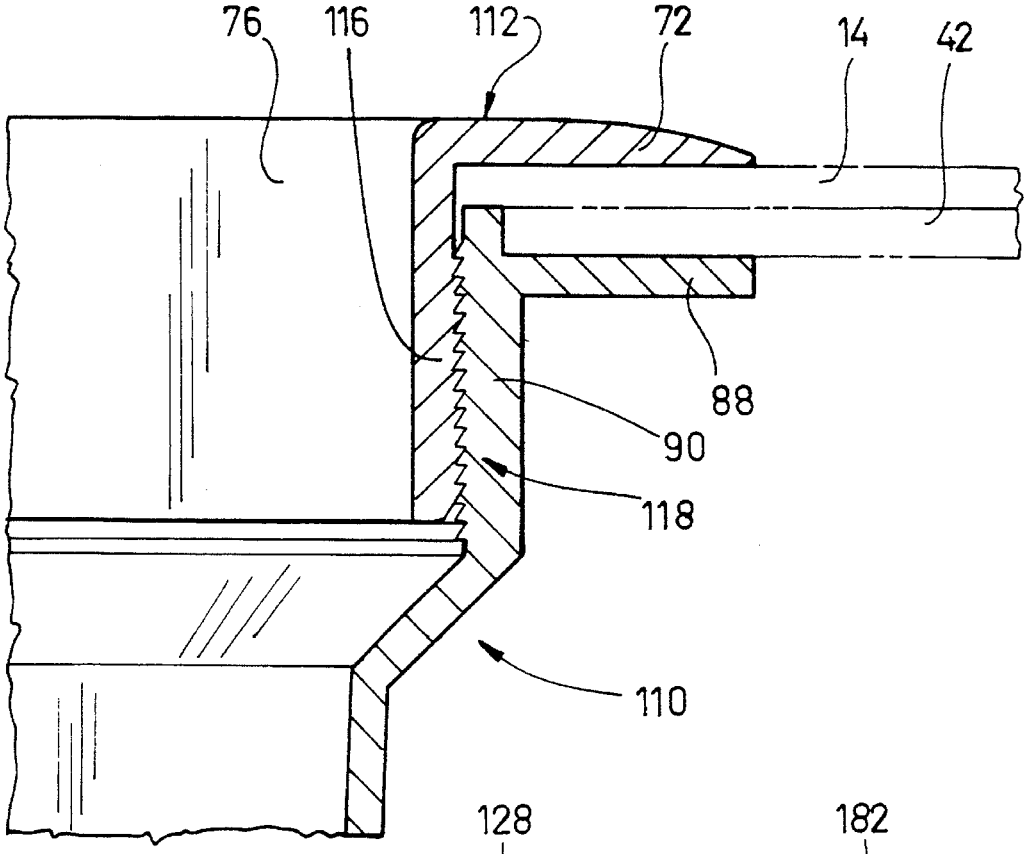
FIG. 11 is view along lines 11—11 of FIG. 8 further detailing the complementary ratchet teeth.

The upper male pan 112 has a circumferential sidewall 76 formed externally with four identical locking structures equally circumferentially spaced apart and each spanning a sector of about 20 degrees. The female part 110 has a circumferential sidewall 90 formed internally with four complementary locking structures equally spaced circumferentially and each spanning a sector of about 20 degrees. A typical pair of complementary locking structures 116, 1 18 is shown in FIG. 11 where the locking structures 116, 118 may be seen to comprise sets of parallel (horizontal) part-circular ratchet teeth shaped to interlock in a downward direction along the central axis 70 of the female part 110 but rotate relative to one another about the central axis 70. The interlocking is progressive and increases as axial separation of the two parts 60, 62 is reduced thereby permitting the male part 62 to be locked to the female part 110 against axial separation in various selectable relative axial positions which accommodate decks or blanks of different thickness. In a predetermined relative angular orientation (as shown in FIG. 7), the four pairs of ratchet teeth are positioned to engage simultaneously as the upper male part 112 is pushed downward into the female part 110 to a locked orientation (as in FIG. 8). (In this embodiment, the upper male part 112 is actually rotated clockwise through about 2–3 degrees after insertion to achieve the exact locked orientation shown in FIG. 8 as explained more fully below.) Relative rotation of the male part 62 through roughly 20 degrees counterclockwise causes the pairs of locking structures to disengage to allow axial separation of the two parts 60, 62.

Figure 8:
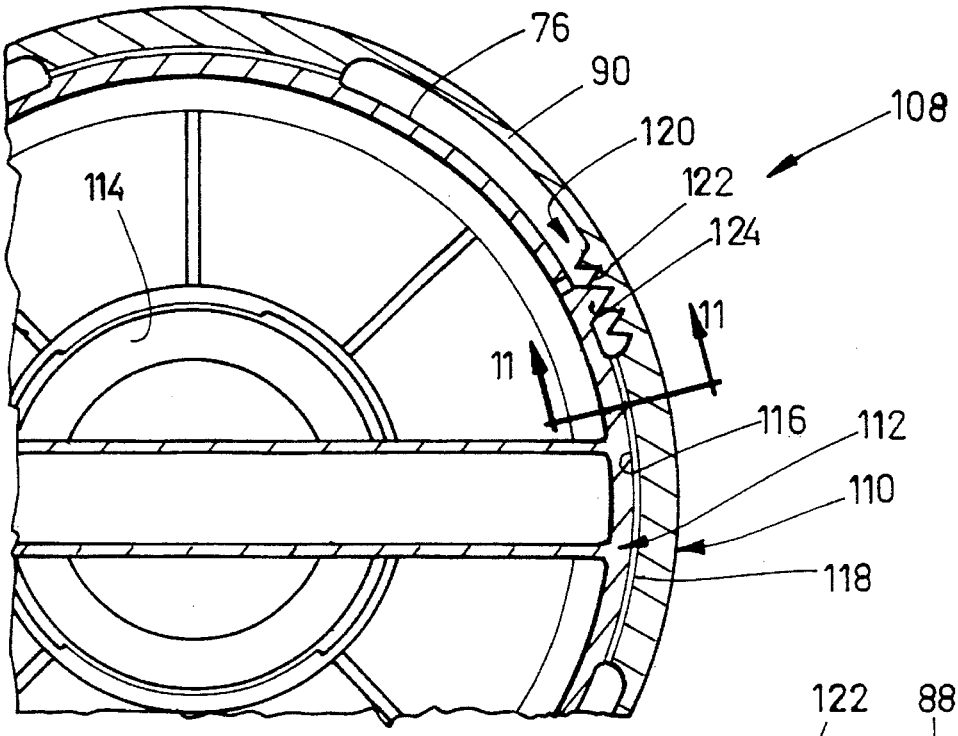
FIG. 8 is an enlarged cross-section of the alternative post in a locked orientation with complementary sets of ratchet teeth mated and a detent mechanism engaged.
Figure 9:
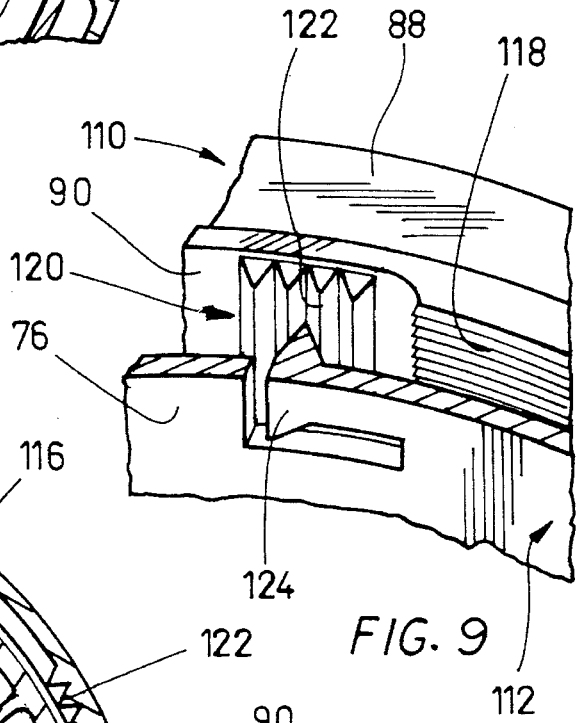
FIG. 9 is a fragmented perspective view of the detent mechanism shown in FIG. 8.
Figure 10:
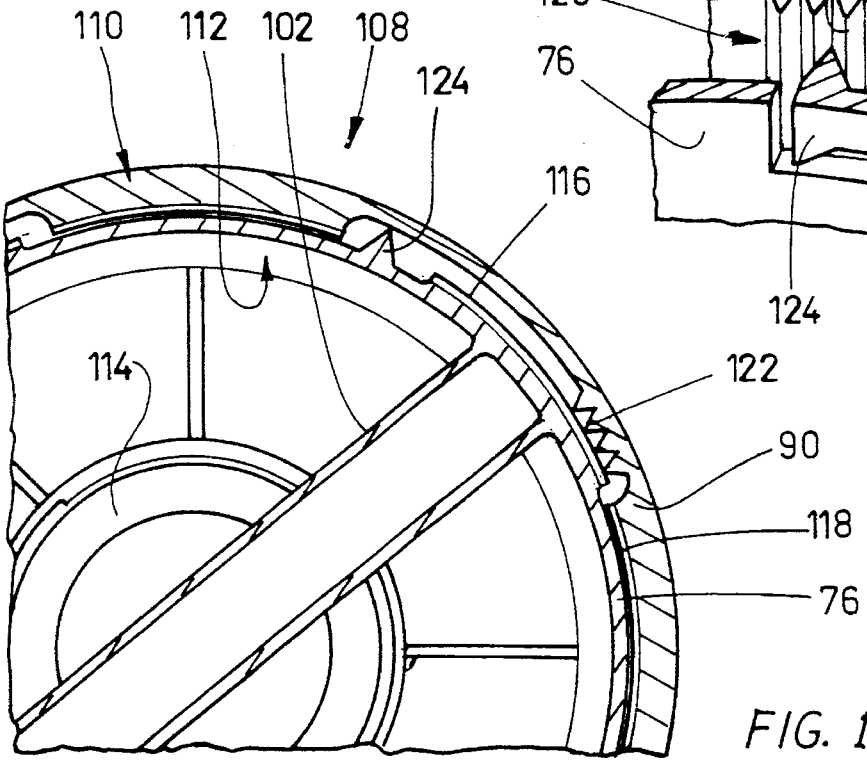
FIG. 10 shows male and female parts of the alternative post rotated to an unlocking orientation.

A detent mechanism 120 (most apparent in FIG. 9) is provided to resist angular rotation of the upper male part 112 relative to the female part 110 between the locked and unlocked orientations. The detent mechanism 120 comprises a set of vertical ratchet teeth 122 formed internally on the circumferential sidewall 90 of the female part 110. The detent mechanism 120 comprises a complementary single tooth or pall 124 formed externally on the cylindrical sidewall 76 of the upper male part 112. The detent structures are positioned so that, when the male part 62 is inserted into the female part 110 and the male part 112 is then rotated clockwise through about 2–3 degrees, the pall 124 engages the ratchet teeth 122 (as shown in FIGS. 8 and 9) to resist relative rotation from the locked orientation in response to jostling or vibration. Manual rotation of the male part 112 through about 2–3 degrees counter-clockwise causes the pail 124 to disengage from the ratchet teeth 122, allowing unhindered rotation of the male part 112 through a total angle slightly greater than 20 degrees to the unlocked unlocked orientation (substantially as shown in FIG. 10) and axial separation of the parts 110, 112 unhindered by the detent mechanism 120. This post construction not only accommodates different deck thicknesses and resists loosening of parts 110, 112 in response to vibration, but also permits non-destructive disassembly of the post 108.

The lower male part 114 is identical to the upper male part 112 except for scale. The female part 110 is formed with internal sets of ratchet teeth (not shown) proximate to its lower end that are used to lock the lower male part 114 to the female part 110 against axial separation and with vertical ratchet teeth (not shown) constituting part of a detent mechanism used to resist rotation of the lower male part 114 between locked and unlocked orientations relative to the female part 110.

Figure 12:
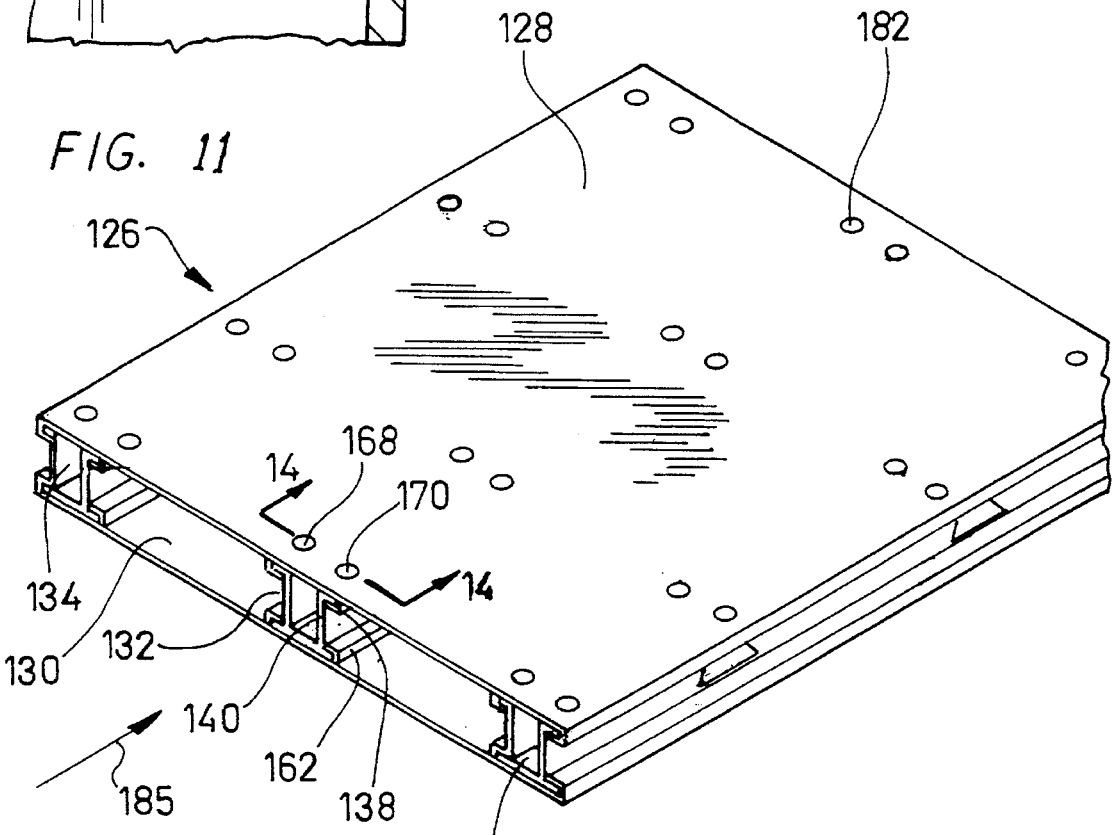
FIG. 12 is a fragmented perspective view of a pallet of entirely plastic construction.

FIG. 12 illustrates a pallet 126 which has an entirely plastic construction. The pallet 126 comprises upper and lower decks 128, 130 joined by three parallel spaced-apart elongate posts 132, 134, 136. A typical post 132 is apparent in FIGS. 13 and 14. The post 132 comprises an elongate track 138 molded with the upper deck 128 and defining a substantially uniform T-shaped slot, and an insert 140 shaped to interlock with the T-slot of the track 138 and displace axially along the length of the track 138. The insert 140 has a flat base 142, a pair of arms 144, 146 that extend perpendicularly and upwardly relative to the base 142, and a pair of flanges 148, 150 that terminate upper ends of the arms 144, 146 and extend perpendicularly and laterally outward relative to the arms 144, 146. Complementary locking structures are formed along the length of the track 138 and the length of the insert 140 to permit progressive interlocking of the insert 140 with the track 138. The locking structure of the insert 140 comprises six upward projections (only two such projections 152, 154 specifically indicated) arranged in two sets of three on each of the flanges 148, 150. The projection 152, which is typical, is molded on a stem 153 defined by slots in the flange 148. The stem 153 allows the projection 152 to deflect along a vertical axis, and, owing to the natural resilience of the constituent plastic, biases the projection 152 to the rest position shown in FIG. 13. The locking structure associated with the track 138 comprises six recesses (only two such recesses 156, 158 specifically indicated) in a spacing arrangement conforming to the spacing of the projections. Each projection has an upper surface inclined at a common angle (such as the surface 159 of the projection 152) so that each projection can deflect downward and disengage from a recess during displacement of the insert 140 relative to the track 138 in the axial direction 160 indicated in FIG. 13. Since this embodiment involves both upper and lower decks 128, 130, the post 132 includes a track 162 moulded with the lower deck 130. The base 142 of the insert 140 is molded with six downward locking projections (two such projections 164, 166 being apparent in FIG. 14) substantially identical to, and vertically registered with, the locking projections associated the flanges 148, 150 of the insert 140. The projections of the base 142 locate within recesses (such as the recesses 168, 170 apparent in FIG. 14) formed the lower deck 130 along its track 162.

In an unlocked orientation, the insert 140 is entirely separate from the pallet 126. It is then advanced progressively along the upper and lower track 138, 162, engaging and disengaging its projections and the associated recesses in the decks 128, 130. Eventually, all locking projections are mated with corresponding recesses in a predetermined locked orientation as shown in FIG. 12 in which the insert 140 is completely between the upper and lower decks 128, 130. Detent mechanisms are positioned to engage to resist displacement of the insert 140 in the axial direction 160 of insertion to an unlocked orientation on an opposite side of the decks 128, 130. One such detent mechanisms, which is typical, comprises a projection 172 extending upwardly from one flange 148 of the insert 140 and mounted on resilient stem 174. The projection 172 locates within a recess 176 (shown in FIG. 12) formed in the deck 128 and associated with the track 138 when the insert 140 reaches it locking orientation. The upper surface 178 of the detent projection 172 is inclined in an angular direction opposite to the upper surfaces of the locking projections, thereby strongly resisting axial displacement in the direction of insertion. A similar detent projection 180 is formed with the other flange 148 and engages a similar detent recess 182 (shown in FIG. 12). The base 142 of the insert 140 is formed with a similar pair of detent projections (only one such detent projection 184 apparent in FIG. 13), but extending downwardly, and the lower deck 130 is formed with similar detent recess (not shown) to receive the projections. The detent mechanisms cooperate with the locking projections and recesses to resist separation of the insert 140 front the decks 128, 130 in response to rough handling of the pallet 126.

The pallet 126 is adapted for four-way entry by a forklift. The spacing of the parallel posts 132, 134, 136 allows entry of forklift tines between the upper and lower decks 128, 130 in the direction 185 shown in FIG. 12. The posts 132, 134, 136 are formed with horizontally aligned clearance holes to allow entry of the tines transverse to the direction 185. In that regard, the insert 140 of the post 132 is typical. As apparent in FIG. 13, the insert 140 has a pair of clearance holes 187 in one vertical arm 146 that are shaped and horizontally spaced to receive the tines. Another substantially identical pair of clearance holes y are formed in the other vertical arm 144, horizontally registered with the clearance holes 187. Similar clearance holes (not indicated) in the inserts of the other posts 134, 136 are registered with the clearance holes 185, 187 when the posts 132.134, 136 are in their predetermined locked positions relative to the decks 128, 130, allowing transverse passage of the forklift tines.

Figure 13:
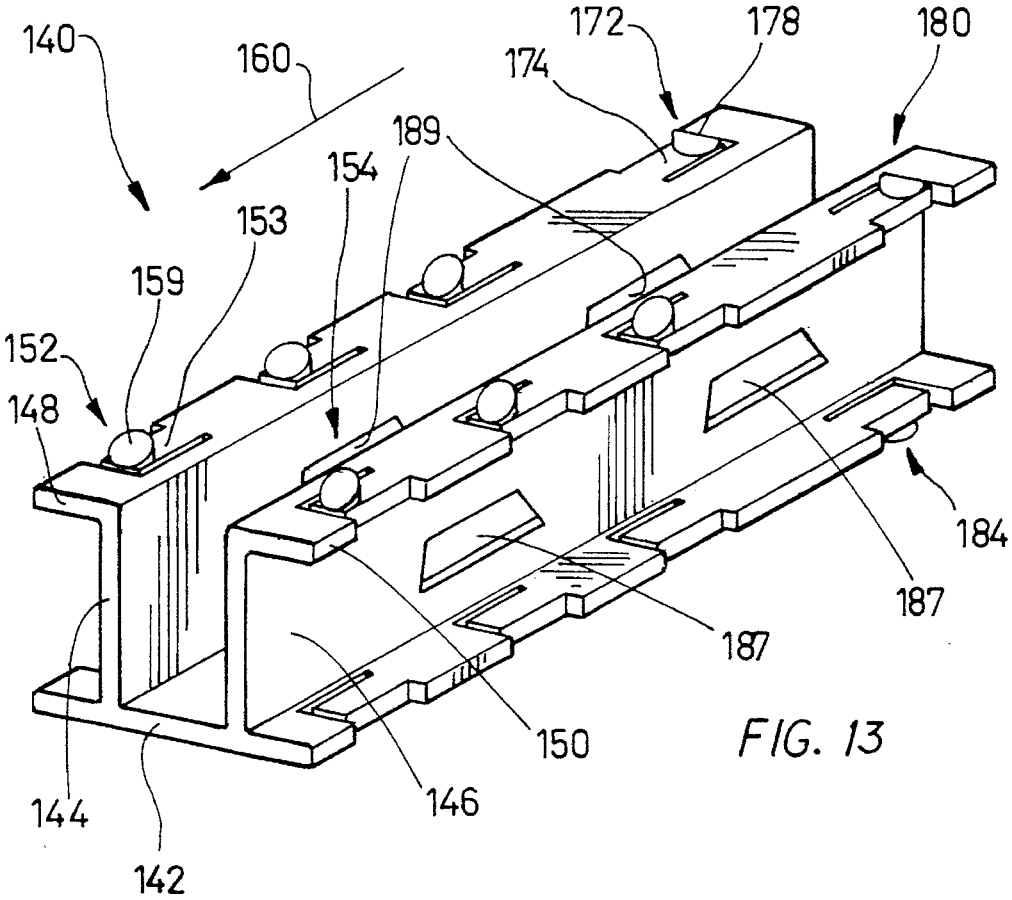
FIG. 13 is a perspective view of an elongate insert used to define a post associated with the pallet.
Figure 14:
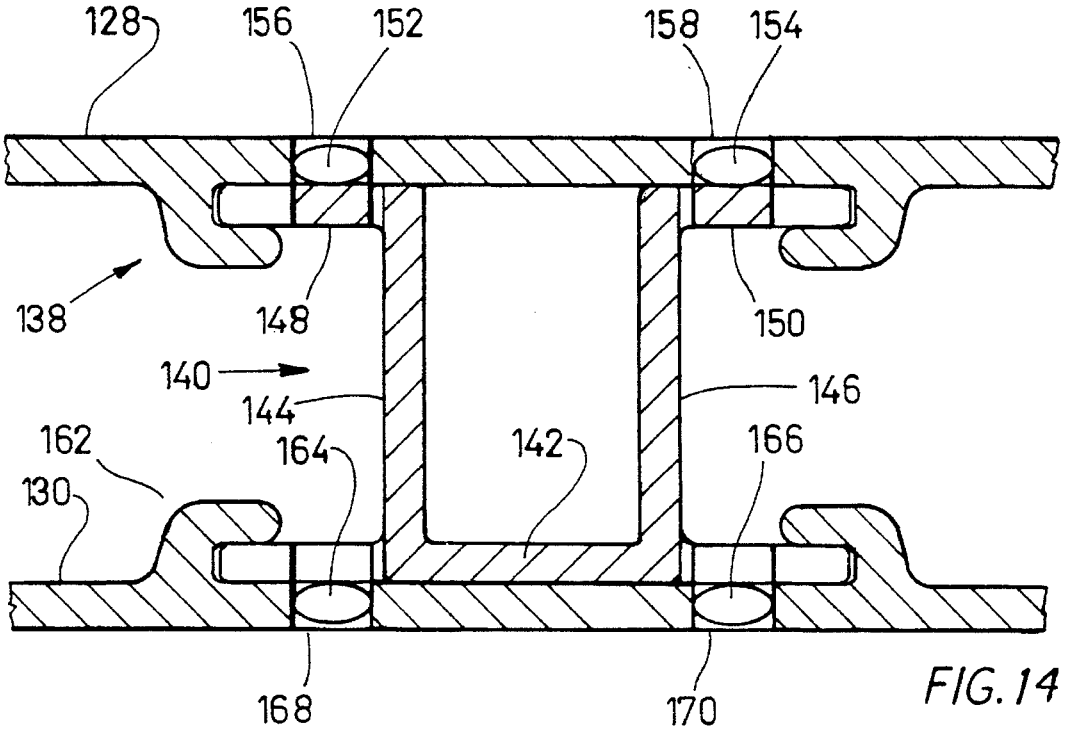
FIG. 14 is a cross-section along the lines 14—14 of FIG. 12.

FIGS. 15–17 illustrate an alternative all-plastic pallet 186 with upper and lower decks 188. 190 and three elongate posts 192, 194, 196. Certain features that are similar to those found in components of the pallet 126 of FIGS. 12–14 are identified with common reference numerals, and the description below will highlight differences in structure or function.

The post 192, which is typical, comprises an insert 198 shown in FIG. 16. The insert 198 has flanges 148, 150 formed with lengthwise sets of ratchet teeth 200, 202. The lower face of the upper deck 188 has a track 204 formed along its length with complementary sets of ratchet teeth (such as the one set of ratchet teeth 206 shown in FIG. 17 mated with the ratchet teeth 200 on one flange 148 of the insert 198) that allow progressive locking of the insert 198 with the track 204. The ratchet teeth 200, 206 are shaped to allow displacement of the insert 198 in an axial direction 160 indicated in FIG. 16 into the track 204 and to resist displacement of the insert 198 in an opposite axial direction relative to the track 204. The flanges 148, 150 are formed with spring-biased detent projections 208 mounted on resilient stems molded with the insert 198 that are received in complementary recesses (not shown) formed in the track 204 when the insert 198 reaches a predetermined locked orientation (as shown in FIG. 15) relative to the upper deck 188 of the pallet 186. The detent projections 208 are shaped to resist further displacement of the insert 198 in the axial direction 160 to an unlocked orientation separate from the pallet 186. The base 142 of the insert 198 is similarly formed with two sets of longitudinal ratchet teeth (not illustrated) and detent projections (only one apparent such projection 210 apparent in FIG. 16) that mate with corresponding lengthwise sets of ratchet teeth (not shown) and detent recesses (not shown) formed with a track 212 molded with an upper face of the lower deck 190.

Several alternatives should be noted. The posts 52, 108 have been described in connection with a pallet 10 comprising a corrugated folding blank 12. The posts 52, 108 can, however, be used with a rigid upper deck formed with appropriate clearance holes to form a pallet. In such a pallet, the posts 52, 108 can be used to attach a rigid lower deck formed with appropriate clearance holes.

It will be appreciated that particular embodiments of the invention has been described and that modifications may be made therein without departing from the spirit of the invention or necessarily departing from the scope of the appended claims.

I claim:

1. A post adapted for attachment to a pallet deck that has a pair of opposing faces and a clearance hole extending between the faces, the post comprising:

a male part shaped to abut one of the faces of the deck and to extend through the clearance hole;

a female part shaped to abut the other of the faces of the deck and to receive the extended male part along a predetermined axis of the female part and to allow relative rotation of the male pan about the axis;

locking means for locking the male part to the female part to resist relative axial separation when the male pan is received within the female part in various relative axial positions, the locking means comprising complementary pairs of locking structures, each of the pairs comprising a locking structure mounted externally on the male pan and another locking structure mounted internally within the female part and shaped to interlock with the locking structure on the male part, the locking structures of each of the pairs being shaped for relative rotation about the axis between an unlocking orientation in which the locking structures peat axial separation of the parts and a locked orientation in which the locking structures are interlocked to resist axial separation of the parts, and, detent means for resisting relative rotation of the pairs of locking structures from their locked orientation toward their unlocked orientation, the detent means comprising a detent structure mounted externally on the male part and a complementary detent structure mounted internally on the female part.

2. The post of claim 1 in which, in each of the pairs of locking structures:

the locking structure formed on one of the pans comprises a plurality of substantially parallel screw thread segments;

the locking structure formed on the other of the parts comprises at least one screw thread segment that meshes with the multiplicity of screw thread segments; and, the one screw thread segment and the multiplicity of screw thread segments are inclined such that relative rotation of the pans in a predetermined angular direction about the axis causes the meshed screw threads to draw the male part axially into the female part.

3. The post of claim 2 in which the detent means comprise, in each of the pairs of locking structures, ratchet teeth formed on each of the plurality of screw thread segments and complementary ratchet teeth formed on the at least one screw thread segment, the ratchet teeth and the complementary ratchet teeth being shaped to mate progressively with one another in response to rotation of the pans in the predetermined angular direction and lock against relative rotation of the parts in a direction opposite to the angular direction.

4. The post of claim 1 in which, in each of the pairs of locking structures:

the locking structure formed on the female pan comprises a multiplicity of parallel, part-circular ratchet teeth oriented perpendicular to the axis; and, the locking structure formed on the male pan comprises a set of parallel, part-circular ratchet teeth shaped and oriented to interlock progressively with the ratchet teeth of the female part as the male part displaces axially into the female part.

5. The post of claim 4 in which:

the detent structure of one of the parts comprises a set of ratchet teeth oriented parallel with the axis; and, the detent structure of the other of the parts comprises a tooth shaped to interlock with the set of ratchet teeth of the detent structure of the one part.

6. The post of claim 4 in which:

each of the pairs of locking structures release when rotated relative to one another through a first angle from their locking orientation to their unlocked orientation; and, the detent structures are positioned to disengage when the pairs of locking structures are rotated from their locked orientation toward their unlocked orientation through a second angle smaller than the first angle.

7. A modular pallet comprising:

a unitary foldable planar blank comprising a central rectangular portion with four sides and a pair of opposing faces, a lateral flap associated with each of the sides of the central portion and joined along a hinge line to the associated side, and a clearance hole adjacent to each of the sides of the central portion;

each of the lateral flaps comprising:

(a) a multiplicity of panels joined by hinge lines such that the flap is foldable into a tubular structure in which one of the panels is parallel to and against one of the faces of the central portion and another of the panels is parallel to and spaced from the one face of the blank;

(b) a clearance hole in the one panel positioned to overlay the clearance hole adjacent to the side of the central portion associated with the flap; and, (c) a clearance hole in the other panel;

at least one post associated with each of the flaps, each of the posts comprising:

(A) a rigid body comprising opposing end portions, the body being shaped for location within the tubular structure defined by folding the associated flap with one of the opposing end portions at the clearance hole of the one panel of the flap and the other of the opposing end portion at the clearance hole of the other panel of the associated flap;

(B) a pair of caps;

(C) first securing means for securing one of the caps to the body such that the central portion and the one panel are secured between the one cap and the one end portion; and, (D) second securing means for securing the other of the caps to the body such that the other panel is secured between the other cap and the other end portion.

8. The modular pallet of claim 7 adapted to be raised by a forklift with a pair of tines, in which:

each of a pair of the flaps on opposing sides of the central portion comprises a pair of panels which are perpendicular to the one face of the central portion and spaced from one another when the flap is folded into a tubular structure, one of the pair of panels comprises one pair of openings which are spaced to receive the tines, and the other of the pair of panels comprises another pair of openings which are spaced to receive the tines and which are registered with the one pair of openings when the pair of flaps are parallel thereby to define a pair of continuous passages through the flap; and, the openings in the pair of flaps are positioned such that the pair of passages defined in one of the pair of flaps is registered with the pair of passages in the other of the pair of flaps when the pair of flaps are folded into tubular structures.

9. The modular pallet of claim 7 in which, for each of the posts:

the one end cap is shaped for insertion into the one end portion of the body;

the other end cap is shaped for insertion into the other end portion of the body;

the first securing means comprising a locking structure mounted to the one cap and a complementary locking structure mounted to the one end portion of the body;

the second securing means comprising a locking structure mounted to the other cap and a complementary locking structure mounted to the other end portion of the body.

10. The modular pallet of claim 9 in which, for each of the post, the first securing means comprise:

locking means for locking the one cap to the one end portion of the body to resist relative axial separation when the one cap is received within the one end portion of the body in various relative axial positions, the locking means comprising complementary pairs of locking structures, each of the pairs comprising a locking structure mounted externally on the one cap and another locking structure mounted internally within the one end portion of the body and shaped to interlock with the locking structure on the one cap, the locking structures of each of the pairs being shaped for relative rotation about the axis between an unlocking orientation in which the locking structures permit axial separation of the one cap and the one end portion of the body and a locked orientation in which the locking structures are interlocked to resist axial separation of the one cap and the one end portion of the body, and, detent means for resisting relative rotation of the pairs of locking structures from their locked orientation toward their unlocked orientation, the detent means comprising a detent structure mounted eternally on the one cap and a complementary detent structure mounted internally on the one end portion of the body.

11. The modular pallet of claim 10 in which, in each of the pairs of locking structures of each of the posts:

the locking structure formed on one of the one cap and the one end portion of the body comprises a plurality of substantially parallel screw thread segments;

the locking structure formed on the other of the one cap and the one end portion of the body comprises at least one screw thread segment that meshes with the multiplicity of screw thread segments; and, the one screw thread segment and the multiplicity of screw thread segments are inclined such that relative rotation of the one cap and the one end portion of the body in a predetermined angular direction about the axis direction causes the meshed screw threads to draw the cap axially into the one end portion of the body.

12. The modular pallet of claim 11 in which in each of the posts, the detent means comprise, in each of the pairs of locking structures, ratchet teeth formed on each of the plurality of screw thread segments and complementary ratchet teeth formed on the at least one screw thread segment, the ratchet teeth and the complementary ratchet teeth being shaped to mate progressively with one another in response to rotation of the one cap and the one end portion of the body in the predetermined angular direction and lock against relative rotation of the one cap and the one end portion of the body in a direction opposite to the angular direction.

13. The modular pallet of claim 10 in which, in each of the pairs of locking structures of each of the posts:

the locking structure formed on the one end portion of the body comprises a multiplicity of parallel, part-circular ratchet teeth oriented perpendicular to the axis; and, the locking structure formed on the one cap comprises a set of parallel, part-circular ratchet teeth shaped and oriented to interlock progressively with the ratchet teeth of the one end portion of the body as the one cap displaces axially into the one end portion of the body.

14. The modular pallet of claim 13 in which in each of the posts:

the detent structure of one of the one cap and the one end portion of the body comprises a set of ratchet teeth oriented parallel with the axis; and, the detent structure of the other of the one cap and the one end portion of the body comprises a tooth shaped to interlock with the set of ratchet teeth of the detent structure of the one of the one cap and the one end portion of the body.

15. The modular pallet of claim 14 in which, for each of the posts:

each of the pairs of locking structures release when rotated relative to one another through a first angle from their locking orientation to their unlocked orientation; and, the detent structures are positioned to disengage from one another when the pairs of locking structures are rotated from their locked orientation toward their unlocked orientation through a second angle smaller than the first angle.

16. A modular pallet comprising:

a deck comprising opposing faces, the deck comprising a plurality, of elongate tracks in parallel spaced-apart relation along one of the faces, each of the tracks comprising locking structure along its length and a detent structure; and, a plurality of elongate inserts, each of the inserts being shaped to interlock with an associated one of the elongate tracks and to displace in interlocked relationship in a predetermined direction along the associated track between an unlocked orientation in which the insert is separate from the associated track and a predetermined locked orientation relative to the one face of the deck, each of the inserts comprising locking structure along its length complementary to the locking structure of the associated track and shaped to interlock progressively with the locking structure of the associated track as the insert is displaced in the predetermined direction to resist displacement of the insert in a direction opposite to the predetermined direction, each of the inserts comprising a detent structure positioned to engage the detent structure of the associated track when the insert is displaced along the associated track to the locked orientation, the detent structure of the insert and the detent structure of the associated track being shaped to resist displacement of the insert in the predetermined direction when engaged.

17. The modular pallet of claim 16 in which for each of the inserts and the associated track;

the locking structure of the track comprises a plurality of rccesses; and, the locking structure of the insert comprises a plurality of projections shaped to locate within the recesses, each of the projections is spring-biased to restore to a predetermined position and shaped to displace from any one of the recesses in which the projection locates in response to displacement of the insert along the track in the predetermined direction.

18. The modular pallet of claim 17 in which, for each of the inserts and the associated track:

the detent structure of the insert comprises a projection spring-biased to restore to a predetermined position and the detent structure of the track comprises a recess; and, the recess and the projection of the detent structure are shaped to interlock in response to displacement of the insert in the predetermined direction relative to the track and to resist displacement of the insert relative to the track in a direction opposite to the predetermined direction when interlocked.

19. The modular pallet of claim 18 in which each of the inserts is integrally formed of a resilient plastic and in which, for each of the inserts, each of the projections of the locking and detent structures of the insert is mounted on an elongate stem which deflects resiliently relative to the rest of the insert thereby spring-biasing the projection.

20. The modular pallet of claim 16 in which for cach of the inserts and the associated track:

the locking structure of the track comprises ratchet teeth; and, the locking structure of the insert comprises complementary ratchet teeth mating with the rancher teeth of the track.

21. The modular pallet of claim 20 in which, for each of the inserts and the associated track:

the detent structure of the insert comprises a projection spring-biased to restore to a predetermined position and the detent structure of the track comprises a recess; and, the recess and the projection of the detent structure are shaped to interlock in response to displacement of the insert in the predetermined direction relative to the track and to resist displacement of the insert relative to the track in a direction opposite to the predetermined direction when interlocked.

22. The modular pallet of claim 21 in which each of the inserts is integrally formed of a resilient plastic and in which, for each of the inserts, the projection is mounted on an elongate stem which deflects resiliently relative to the rest of the insert thereby spring-biasing the projection.

23. The modular pallet of 16 adapted to receive a pair of tines of a forklift in a direction transverse to the predetermined direction, in which each of the inserts comprises a pair of clearance passage horizontally spaced apart and shaped to receive the tines, and the pairs of clearance passages in the inserts are registered horizontally when the inserts are in their locked orientations.

* * * * *